United States Patent [19]

Bower, Jr.

[11] 4,269,704

[45] May 26, 1981

[54] SCREEN FOR PARTICLE SEPARATION

[75] Inventor: Arnold B. Bower, Jr., Bristol, Va.

[73] Assignee: General Electric Company, Detroit, Mich.

[21] Appl. No.: 93,237

[22] Filed: Nov. 13, 1979

[51] Int. Cl.[3] ..... B07B 1/46

[52] U.S. Cl. ..... 209/393; 209/395; 209/400; 210/483

[58] Field of Search ..... 209/392–396, 209/400, 405; 210/483, 510

[56] References Cited

U.S. PATENT DOCUMENTS 3,751,271 8/1973 Kimura et al. ..... 210/510 X

FOREIGN PATENT DOCUMENTS 1141241 12/1962 Fed. Rep. of Germany ..... 209/393

45-2513 1/1970 Japan ..... 209/393

*Primary Examiner*—William A. Cuchlinski, Jr.

*Attorney, Agent, or Firm*—Morgan, Finnegan, Pine, Foley & Lee

[57] ABSTRACT

A screen for separating particles is disclosed which consists of a plurality of rows of elongated members disposed in a parallel array. The elongated members are formed from segmented tubular sections which are interconnected and are made from a cemented carbide material. The screen is especially useful in industrial applications where high abrasion resistance and increased screen life is necessary.

16 Claims, 5 Drawing Figures

SCREEN FOR PARTICLE SEPARATION

This subject invention relates to a screen for separating particles, and composed of a plurality of rows of elongated members or rods disposed in a spaced parallel array. Each rod is composed of a plurality of segmented sections formed from a cemented carbide material and interconnected by a continuous wire or dowels. Due to the high abrasion resistance and resultant long life of cemented carbide materials, the screen of the subject invention is especially useful in heavy industrial applications such as in the separation of coal, stone, or iron ores.

BACKGROUND OF THE INVENTION

It is known that in many industries material separation or particle sizing is accomplished by using various types of screens. More particularly, heavy industries which deal with the production of coal, stone, gravel, iron ore, potash, copper, etc., use screens of various sizes and configurations to separate unwanted materials or to merely produce particles having a uniform maximum or minimum size.

Screens which have been employed in the prior art were generally formed with a plurality of rows of stainless steel rods. While these rods were fairly lightweight, and easy to produce, their abrasion resistance to hard materials such as coal, stone, or gravel is low. More specifically, in industries where a constant shower of heavy hard particles was funneled through screens formed from stainless steel rods, the rods would gradually wear away thereby enlarging the spacing between the rods. In addition, as particles build up on the screen they are periodically scraped away with, for example, a wire brush which resulted in the further erosion of the stainless steel rods. Once the spacing between the rods increased beyond a defined limit, the screen had to be discarded, since the screen would fail to produce particles within the required tolerances. Screens employed for industrial uses tend to be very large, and therefore, maintenance time to replace a screen deck is substantial. In addition, of course, new stainless steel rods must be refabricated thereby increasing overall manufacturing costs.

Therefore, it is an object of the subject invention to provide an industrial screen with improved abrasion resistance.

It is another object of the subject invention to provide an industrial screen wherein the distances between the members will remain constant over a longer period of time.

It is still a further object of the subject invention to provide an industrial screen which can be maintained at reduced costs.

DESCRIPTION OF THE INVENTION

Figure 1:
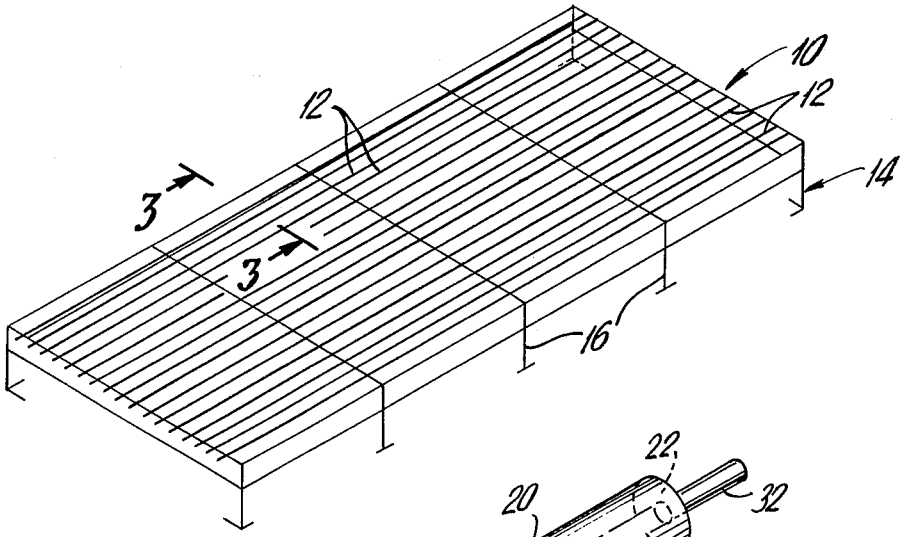
FIG. 1 is a schematic view of the screen of the subject invention and illustrates a plurality of elongated members or rods disposed in spaced, parallel array.

According to the subject invention, there is provided a screen for separating particles which consists of a plurality of rows of elongated members or rods disposed in a spaced, parallel array. Each rod is formed from a plurality of segmented sections which are interconnected and made from a cemented carbide material. The segmented sections are connected together to form the rods and are then mounted on a supporting frame to form the screen of the subject invention, as more fully described hereinafter.

In accordance with the subject invention, each segmented section of rods is made of a cemented carbide material having high abrasion resistance, and is of generally cylindrical configuration. Carbides include tungsten carbide, titanium carbide, chromium carbide and silicon carbide. In general, refractory carbides exhibit excellent thermodynamic stability, with generally lower vapor pressure and high mechanical strength at elevated temperatures. As an example, the melting point of tungsten carbide is 2,750° C., while the abrasion resistance measured in kilograms per millimeter squared is 3,000.

A cemented carbide is a composite structure where a metal is bonded with a carbide, thereby imparting additional strength to the composition. Common binding metals include cobalt and nickel. Typically, 6 to 10% cobalt may be added to a material such as tungsten carbide to form a cemented carbide.

Accordingly, it is the primary object of the subject invention to overcome the shortcomings of the prior art screens, and provide a more efficient and economical screen for use in industries dealing with coal, stone, gravel, etc.

Therefore, in accordance with the subject invention, a plurality of parallel elongated screen members are formed from segmented sections interconnected to form straight elongated rods of the desired length. More specifically, individual interconnected segmented sections are provided which are preferably on the order of 12 to 18 inches in length, with the configuration of each section preferably being tubular or cylindrical, but it may also be of any configuration required for the desired screen application. The segmented sections are joined by interconnecting means such as a support wire or dowels and are mounted on a support frame to maintain the rods at the required spacing for screening purposes.

In one embodiment of the subject invention, the segmented sections are tubular and include an axial bore, with the segments being interconnected by a wire extending through the tubular segmented sections, thereby supporting and aligning the sections in a straight row. An adhesive may be added between the abutting sections or along the wire to more fully secure the sections to the wire and to each other.

In accordance with the second embodiment of the subject invention, the segmented sections are of generally cylindrical configuration and are provided with slots on either end thereof which are adapted to receive a pin therein. More specifically, a pin acting as a dowel, is inserted into the slot at one end of a segmented section and adhesively joined thereto, while the other end of the pin is received in the slot in the adjacent, abutting segmented section and adhesively joined thereto. By this arrangement, abutting sections are joined to each other forming a straight aligned rod. The depth of the slots and the length of the pin are arranged such that the side edges of the segmented sections will abut one another so that they too may be adhesively joined. The shape and length of the pins, as well as the depth of the slots are chosen in accordance with the specific end use of the screen.

The elongated members or rods, formed in accordance with the preferred embodiments of the subject invention, are mounted on a support frame to define a spaced, parallel array of rods. The support frame includes supporting members which extend orthagonal to the lengths of the rods and are spaced along the support frame. The supporting members may consist of transverse portions having recesses corresponding to the configuration of the segmented sections so that the rods may be conveniently supported thereon.

By forming the rods from a cemented tungsten carbide material the abrasion resistance of the resulting screen will be substantially increased. Accordingly, the spaces between the rods will be maintained for a longer period of time, and therefore, total down time for the maintenance and replacement of screen rods is significantly reduced.

DESCRIPTION OF THE PREFERRED EMBODIMENTS

Figure 3:
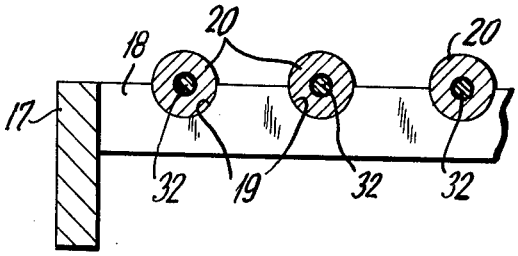
FIG. 3 is a partial cross sectional view of the screen of the subject invention taken along line 3—3 in FIG. 1.

As illustrated in FIG. 1, the screen of the subject invention, indicated generally by the numeral 10, consists of a plurality of rows of elongated members 12 disposed in spaced, parallel array. The elongated members 12 are supported by frame 14 consisting of support members 16 which extend perpendicular to the spaced array. More particularly, as illustrated in FIG. 3, each support member 16 is provided with leg portions 17 and a transverse member 18. Transverse member 18 is provided with a plurality of recesses 19 which generally conform to the configuration of the elongated members 12. By this arrangement, proper spacing between the elongated members is achieved. Preferably, spacings on the order of a half inch are desired although that may vary with the particular application of the screen.

The elongated members 12 are formed from a plurality of interconnected, segmented sections 20. Each segmented section is preferably tubular in configuration, but may be of any other configuration suitable for use with the particular application. Each segmented section 20 has a length of approximately 12 to 18 inches and is provided with flat ends 22.

In accordance with the subject invention, the sections 20 are formed from a cemented carbide material in which a metal such as cobalt or nickel is used to harden the carbide composition. Tungsten carbide, for example, has excellent abrasion resistant properties, and, when 6 to 10% of a binder metal such as cobalt is combined with tungsten carbide, the abrasion resistance is further increased. Thus, the use of cemented carbide rods will extend the life of the screen of the subject invention by preventing the spacing between the rods from enlarging as a result of extensive screening operations.

Figure 2:
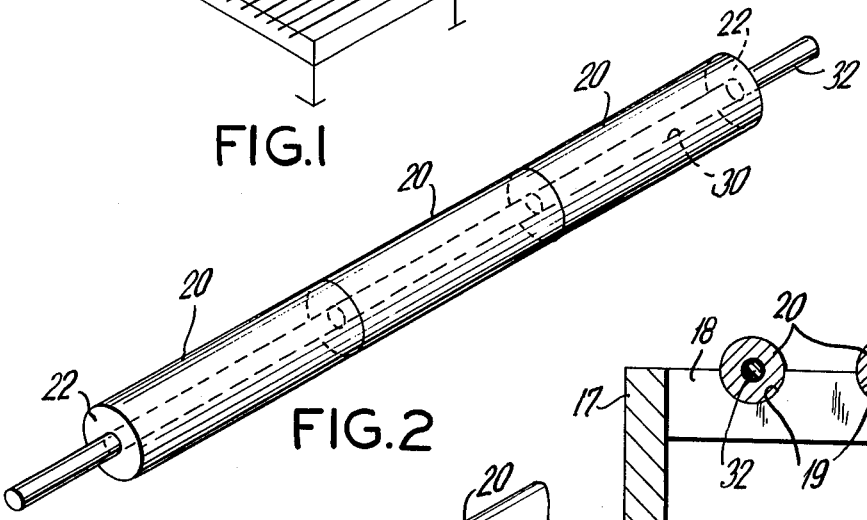
FIG. 2 is a perspective view of a single rod illustrating the segmented sections connected in accordance with a first embodiment of the subject invention.

As illustrated in FIGS. 2 and 3, the segmented sections 20 are preferably molded or formed with an axial bore 30. The segmented sections 20 are connected and aligned by means of a wire 32 extending through the bores 30 in the segmented sections 20. Prior to passing the wire 32 through the sections 20, the wire may be coated with a suitable adhesive. In addition, the ends 22 of the segmented sections 20 may also be coated with an adhesive to form a more sturdy connection between the sections 20 which defined rods 12. The segmented sections 20, now formed into rods 12, may then be attached to the support frame 14 by means of the wires 32. The rods 12 are mounted in the recesses 19 such that the support frame supports and spaces the rods at the required distance. The length and spacing between the rods 12 is determined according to the particular application and industry usage of the screen 10.

Figure 4:
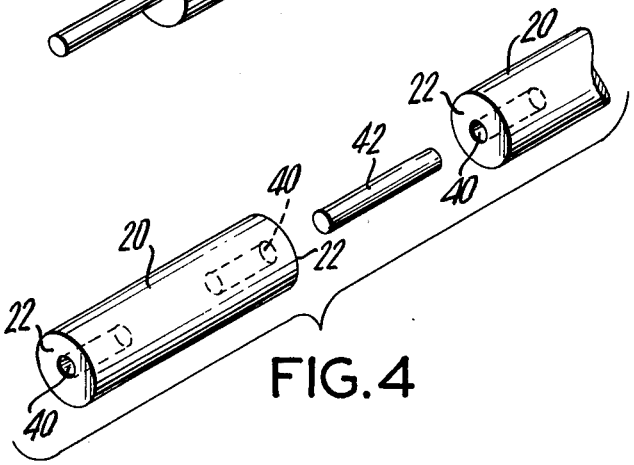
FIG. 4 is an exploded perspective view of the segmented sections illustrating their connection according to a second embodiment of the subject invention.
Figure 5:
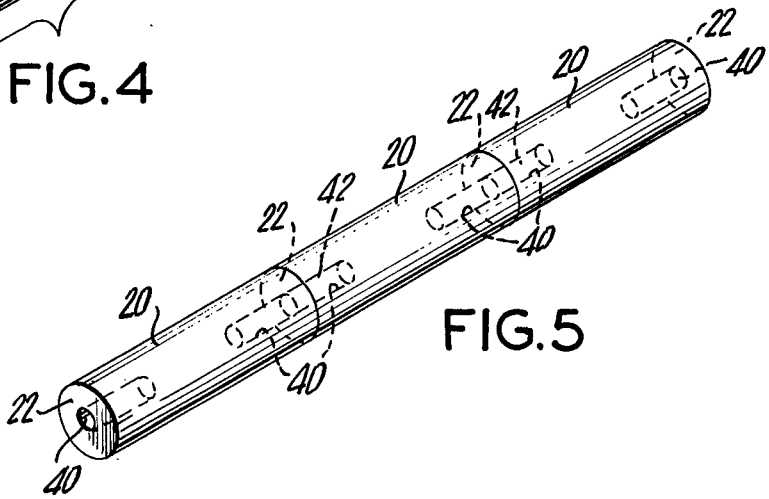
FIG. 5 is a perspective view illustrating the connection of segmented sections according to the second embodiment of the subject invention.

An alternative arrangement for connecting the segmented sections is disclosed in accordance with the second embodiment of the subject invention, as illustrated in FIGS. 4 and 5. In this embodiment, each cylindrical, segmented section 20 is formed with slots 40 in the opposed ends 22 thereof, which slots extend to a point intermediate the length of the segmented section 20. Abutting sections 20 are connected by inserting a dowel or pin 42 therebetween. Pin 42 has a cross-section substantially similar to the cross-section of slot 40, and has a length approximately twice the length of the slot 40. Each pin 42 is received into a slot 40 until the end of the pin 42 reaches the end of the slot 40, while the opposed end of the pin is then inserted into the slot 40 of an adjacent segmented section 20 such that the respective ends 22 of the segmented sections 20 abut one another. As in the first embodiment, pin 42, as well as ends 22, may be coated with an adhesive for increasing the stability of the connection between the segments 20.

As illustrated in FIG. 5, a plurality of segments 20 are interconnected by pins 42 to form an elongated rod 12. The rods 12 are then mounted on frame 14 thereby forming the screen 10 of the subject invention.

Screen 10 may be used where particle separation or particle sizing is necessary. For example, in the mining and gravel industries, it is frequently necessary to separate larger masses of material from smaller particulates. The pieces of material having assorted sizes are funneled through the screen 10 of the subject invention such that the larger pieces are trapped on top of the screen 10 and cannot pass therethrough. The width of the spacing between the rods 12 determines the size of the particles which may pass freely through the screen 10 to be collected below. Since the rods 12 are formed from a cemented carbide material, their abrasion resistance is greatly increased and thus, a constant spacing between the rods 12 is maintained for a longer period of time than heretofore attained with conventional screens. By the subject arrangement, only particles of the desired size will pass through the screen 10 to be collected below, thereby reducing operating costs incurred in the removal of unwanted, oversized particles from the collection.

Accordingly, there is provided a new and improved screen for separating particles consisting of a plurality of rows of elongated, cemented carbide members which are disposed in a spaced, parallel array. The segmented sections are then interconnected to form the elongated rod members. Each section is preferably formed with a central bore and the sections are connected by a wire extending therethrough to form an aligned, straight elongated rod member. In an alternative embodiment, the ends of the cemented carbide sections are provided with slots such that dowels may interconnect adjacent, abutting segmented sections to form aligned straight rods. The rods are mounted on a frame which functions to support the individual rods and maintain uniform spacings between each rod.

It is to be understood that changes may be made in the particular embodiment of the invention in light of the above teachings, but that these will be within the full scope of the invention as defined by the appended claims.

I claim:

1. A screen for separating particles comprising:

a plurality of rows of elongated members disposed in fixed, spaced parallel array, said elongated members being formed from segmented sections of a cemented carbide material, each said segmented section having an axial bore therein;

means for connecting said segmented sections to form said rows of elongated members, said means for connecting said segmented sections to form said rows includes a wire extending through the axial bores of said segmented sections to thereby align and fixedly hold said sections in a straight row; and means for supporting said members in said array.

2. A screen as recited in claim 1 wherein said means for supporting said members is a frame, said frame including a plurality of transverse members, each transverse member having a plurality of recesses corresponding to the configuration of said segmented sections, said recesses positioned to engage said segmented sections intermediate the length thereof, said transverse members thereby supporting and spacing said elongated members in parallel array.

3. A screen as recited in claim 1 wherein said segmented sections are of generally cylindrical configuration.

4. A screen as recited in claim 1 wherein said cemented carbide material is tungsten carbide.

5. A screen as recited in claim 4 wherein said cemented carbide further includes cobalt.

6. A screen for separating particles comprising:

a plurality of rows of elongated members disposed in a spaced parallel array, said elongated members being formed from segmented sections of a cemented carbide material, each section being provided with slots in the opposed ends thereof; means for supporting said rods in said array; and a plurality of pins, with the end of each pin being partially received within a slot of one segmented section while the other end of said pin is partially received within the slot of the abutting segmented section, said pins functioning as dowels to interconnect and align said abutting segmented sections in a straight row.

7. A screen for separating particles comprising:

a plurality of rows of elongated members disposed in a spaced parallel array, said elongated members being formed from segmented sections of a cemented carbide material, each said segmented section being provided with slots in the opposed ends thereof;

means for connecting said segmented sections to form said rows of elongated members, said means for connecting said segmented sections including a plurality of pins, the end of each pin being partially received within a slot of one segmented section and with the other end of said pin being partially received within the slot of the abutting segmented section, said pins functioning as dowels to hold and align said abutting segmented sections in a straight row; and means for supporting said members in said array.

8. A screen as recited in claim 7 wherein said means for supporting said rods is a frame, said frame including a plurality of transverse members, each transverse member having a plurality of recesses corresponding to the configuration of said segmented sections, said recesses positioned to engage said segmented sections intermediate the length thereof, said transverse members thereby supporting and spacing said elongated members in parallel array.

9. A screen as recited in claim 7 wherein said segmented sections are of generally cylindrical configuration.

10. A screen as recited in claim 7 wherein said cemented carbide material is tungsten carbide.

11. A screen as recited in claim 10 wherein said cemented carbide further includes cobalt.

12. A screen for separating particles comprising:

a plurality of rows of elongated members disposed in a spaced parallel array, said elongated members being formed from segmented sections of a cemented carbide material;

means for connecting said segmented sections to form said row of elongated members, said means for connecting said segmented sections including an adhesive placed between abutting ends of said segmented sections; and means for supporting said members in said array.

13. A screen as recited in claim 12 wherein said means for supporting said members is a frame, said frame including a plurality of transverse members, each transverse member having a plurality of recesses corresponding to the configuration of said segmented sections, said recesses positioned to engage said segmented sections intermediate the length thereof, said transverse members thereby supporting and spacing said elongated members in parallel array.

14. A screen as recited in claim 12 wherein said segmented sections are of generally cylindrical configuration.

15. A screen as recited in claim 12 wherein said cemented carbide material is tungsten carbide.

16. A screen as recited in claim 15 wherein said cemented carbide further includes cobalt.

* * * * *